US009144316B1

(12) United States Patent
Sapir

(10) Patent No.: US 9,144,316 B1
(45) Date of Patent: Sep. 29, 2015

(54) PROGRAMMER'S CHAIR

(71) Applicant: Igal Sapir, Vernon, CA (US)

(72) Inventor: Igal Sapir, Vernon, CA (US)

( * ) Notice: Subject to any disclaimer, the term of this patent is extended or adjusted under 35 U.S.C. 154(b) by 0 days.

(21) Appl. No.: 14/074,512

(22) Filed: Nov. 7, 2013

Related U.S. Application Data

(60) Provisional application No. 61/724,294, filed on Nov. 8, 2012.

(51) Int. Cl.

| | |
|---|---|
| ***A47B 83/02*** | (2006.01) |
| ***A47C 7/54*** | (2006.01) |
| ***A47C 7/68*** | (2006.01) |
| ***A47C 7/70*** | (2006.01) |

(52) U.S. Cl.
CPC .... *A47C 7/68* (2013.01); *A47C 7/70* (2013.01)

(58) Field of Classification Search
CPC ..... A47C 7/68; A47C 7/543; A47C 7/70
USPC ..... 297/161, 411.37, 411.36, 354.12, 327, 297/173, 313, 411.31, 116, 188.15, 188.14, 297/301.1, 411.35, 411.25
See application file for complete search history.

(56) References Cited

U.S. PATENT DOCUMENTS

| | | | | |
|---|---|---|---|---|
| 1,721,221 | A * | 7/1929 | Jauregui | 297/344.18 |
| 5,022,706 | A * | 6/1991 | Bryan | 297/162 |
| 5,087,096 | A * | 2/1992 | Yamazaki | 297/145 |
| 5,122,786 | A * | 6/1992 | Rader | 345/168 |
| 5,364,166 | A * | 11/1994 | Zegeer | 297/411.39 |
| 5,612,718 | A * | 3/1997 | Bryan | 345/168 |
| 6,003,940 | A * | 12/1999 | Jackson | 297/217.3 |
| 6,017,085 | A * | 1/2000 | LaCroix et al. | 297/173 |
| 6,045,179 | A * | 4/2000 | Harrison | 297/188.2 |
| 6,056,363 | A * | 5/2000 | Maddox | 297/325 |
| 6,092,868 | A * | 7/2000 | Wynn | 297/217.3 |
| 6,206,464 | B1 * | 3/2001 | Santa Rosa et al. | 297/173 |
| 6,237,997 | B1 * | 5/2001 | Olson | 297/162 |
| 6,520,587 | B2 * | 2/2003 | Noiseux | 297/411.37 |
| 7,219,956 | B2 * | 5/2007 | Zhang | 297/195.11 |
| 7,293,825 | B2 * | 11/2007 | Vergara et al. | 297/1 |
| 7,695,061 | B2 * | 4/2010 | Olarte | 297/162 |
| 7,862,111 | B2 * | 1/2011 | Steenson | 297/161 |
| 2003/0141750 | A1 * | 7/2003 | Rossko | 297/188.21 |
| 2009/0257807 | A1 * | 10/2009 | Woloschyn | 400/489 |
| 2010/0001567 | A1 * | 1/2010 | Powicki et al. | 297/301.1 |
| 2011/0031785 | A1 * | 2/2011 | Steenson | 297/161 |

* cited by examiner

*Primary Examiner* — Milton Nelson, Jr.
(74) *Attorney, Agent, or Firm* — QuickPatents; Kevin Prince

(57) ABSTRACT

A chair for supporting a person above a floor surface and used with a split-keyboard includes a base, a seat, a backrest, and a pair of opposed armrests. Each armrest is vertically adjustable and includes a malleable upper arm support cushion and a rigid support beam. A distal end of the arm support cushion terminates at a wrist support such that the person's wrist height relative to their elbow height when seated may be adjusted. Each wrist support terminates in a keyboard rest and may be tilted so that the angle of the person's wrist when resting on the arm support cushion may be adjusted as well as the curvature of the arm support cushion. The keyboard rest is further adjustable with respect to the arm rest in terms of relative height, lateral and longitudinal distance, roll angle, tilt angle, and yaw angle.

11 Claims, 10 Drawing Sheets

PROGRAMMER'S CHAIR

CROSS-REFERENCE TO RELATED APPLICATIONS

This application claims the benefit of U.S. Provisional Patent Application 61/724,294, filed on Nov. 8, 2012, and incorporated herein by reference.

STATEMENT REGARDING FEDERALLY SPONSORED RESEARCH AND DEVELOPMENT

Not Applicable.

FIELD OF THE INVENTION

This invention relates to chairs, and more particularly to an ergonomic split-keyboard chair.

DISCUSSION OF RELATED ART

Office chairs for those using computer keyboards are known to cause fatigue for users sitting in such chairs for long periods of time, such as several hours. Many prior art and so-called "ergonomic" office chairs are known, including several that provide for use with a split-keyboard (separate keyboards for each hand).

For example, U.S. Pat. No. 5,612,718 to Bryan on Mar. 18, 1997 teaches a chair with a split keyboard. While such a product is adjustable to the specific user in several important ways, there are several ways in which such a product is not well adjustable to particular users. For example, the height of the keyboard tray with respect to the end of each armrest to which the tray is affixed is not adjustable. Further, the curvature of each armrest is not adjustable, nor is the lateral position of the keyboard tray with respect to the end of each armrest.

One drawback of such a device is that to exit the chair the armrests are tilted away from the user, which results in the tilting of the keyboard trays at the end of the armrests. Items temporarily placed on such trays, such as a coffee cup, calculator or the like, must necessarily be removed to avoid them sliding off of the tray as the tray tilts, or each tray must be angularly adjusted to compensate, a somewhat cumbersome project when a user just wants to exit the chair briefly (FIG. 30).

U.S. Pat. No. 5,122,786 to Rader on Jun. 16, 1992 teaches a combination split keyboard and armrest assembly having various adjustment capabilities. The height of the armrest with respect to a seat (not shown) is adjustable, as well as the tilt of the armrest, forward and backward position of the armrest with respect to the seat, and the rotational angle of the armrest and keyboard. With such a product, however, the height of the keyboard tray with respect to the end of each armrest to which the tray is affixed is not adjustable. Further, the curvature of each armrest is not adjustable, nor is the lateral position of the keyboard tray with respect to the end of each armrest.

Other split-keyboard chair, armrest and keyboard tray arrangements are disclosed in U.S. Pat. No. 5,311,210 to O'Brien on May 10, 1994; U.S. Pat. No. 6,237,997 to Olson on May 29, 2001; U.S. Pat. No. 5,818,357 to Motoyama on Oct. 6, 1998; U.S. Pat. No. 6,056,363 to Maddox on May 2, 2000; and U.S. Pat. No. 7,862,111 to Steenson on Jan. 4, 2011. All such devices fail to provide all of the adjustments desirable for allowing prolonged use of a split keyboard by a user while minimizing fatigue.

Therefore, there is a need for a chair that provides the following features and adjustments: 1. split keyboard with keyboard trays attached to ends of arm rests; 2. keyboard trays projecting away from the ends of the arm rests adjustable in tilt, rotation and yaw; 3. arm rest pivots in tilt and yaw; 4. arm rest raises and lowers with respect to seat; 5. arm rest contour is adjustable with armrest wrist adjustment plate; 6. keyboard tray raises and lowers independently from arm rest; and 7. keyboard tray distance from arm rest is longitudinally and laterally adjustable. Many of the above adjustments could be electronically controlled with a linear motor or pneumatic or hydraulic cylinder. Such a needed device would preferably have a minimum of component parts to reduce manufacturing costs and increase ease-of-use. The present invention accomplishes these objectives.

SUMMARY OF THE INVENTION

The present device is a chair for supporting a person in a neutral, rested position above a horizontal surface, such as a floor surface. The chair is preferably used with a split-keyboard. A rigid base has a plurality of wheels each adapted for rolling along the horizontal surface. The base further includes a rigid, central vertical shaft projecting upward from the base.

The seat mechanism has at a lower side thereof a shaft receiver that is adapted for receiving the central vertical shaft. An upper side of the seat mechanism includes a support surface for the person's posterior while seated.

A backrest mechanism is attached at a bottom side thereof with the seat mechanism. The backrest mechanism may be rotatably attached at the bottom side thereof with the seat mechanism. In such an embodiment, a normally locked backrest tilt actuator prevents rotation of the backrest mechanism with respect to the seat mechanism unless actuated, whereby the tilt of the backrest mechanism with respect to the seat mechanism may be manually and selectively adjusted.

A pair of opposed armrest mechanisms is included, each armrest mechanism projecting forward and away from opposing sides of the backrest mechanism. Each armrest mechanism further includes a proximal end pivotally fixed with the backrest mechanism about a substantially vertical armrest post. As such, the arms may be opened away from each other to allow easier ingress or egress from the chair. A distal end of each armrest mechanism terminates in a keyboard rest mechanism.

Each armrest mechanism may be slidably engaged with the armrest post and include an armrest vertical locking mechanism adapted for selective manual locking of the vertical position of the armrest mechanism with respect to the armrest post. In one embodiment, each armrest mechanism includes a malleable upper arm support cushion and a rigid support beam. A proximal end of the arm support cushion and a proximal end of the rigid support beam each terminate at the proximal end of the armrest mechanism at a vertical armrest post receiver. A distal end of the arm support cushion terminates at a wrist support mechanism and a distal end of the support beam terminates at a first wrist height adjustment plate.

The armrest mechanism may include a second wrist height adjustment plate adapted to be slidably captured and selectively fixed with the first wrist height adjustment plate with at least one wrist height adjustment screw. As such, the distal end of the arm support cushion be selectively raised or lowered with respect to the rigid support beam, such that the person's wrist height relative to their elbow height when seated may be adjusted thereby.

Each wrist support mechanism may include a wrist support plate pivotally fixed with the second wrist height adjustment plate at a wrist pivot adjustment screw. As such, upon loosening of the wrist pivot adjustment screw the wrist support mechanism may be tilted forward or backward with respect to the second wrist height adjustment plate and the rest of the chair so that the angle of the person's wrist when resting on the arm support cushion may be adjusted. Further, when adjusted in conjunction with the first wrist height adjustment plate the curvature of the arm support cushion may be adjusted.

In one embodiment, the height of the keyboard rest mechanism with respect to the distal end of the armrest mechanism is selectively adjustable. In another embodiment, the distance between the distal end of the armrest mechanism and a keyboard support tray is selectively adjustable. The keyboard support tray may be further rotatably adjustable about a keyboard rest shaft. In one embodiment, each keyboard support tray is fixed with a keyboard support bracket that is pivotally fixed through a keyboard support tray pivot screw with a keyboard rest shaft receiver. As such, the keyboard support tray may be tilted up or down with respect to the keyboard rest shaft and the keyboard shaft receiver.

In another embodiment, the keyboard rest mechanism further includes a keyboard yaw bracket fixed with the keyboard support bracket at a vertically oriented pivot. In such an embodiment the keyboard support tray may be rotated about a vertical axis to adjust the yaw angle with respect to the longitudinal axis of the armrest mechanism.

In a preferred mode of the invention, each keyboard support tray and keyboard support bracket are mutually, slidably, selectively, and adjustably fixed with at least one keyboard lateral adjustment screw. As such, the keyboard support tray may be laterally adjusted from left to right with respect to the distal end of the armrest mechanism.

The present invention is a chair that provides at least the following features and adjustments: 1. split keyboard with keyboard trays attached to ends of arm rests; 2. keyboard trays projecting away from the ends of the arm rests adjustable in tilt, rotation and yaw; 3. arm rest pivots in tilt and yaw; 4. arm rest raises and lowers with respect to seat; 5. arm rest contour is adjustable with armrest wrist adjustment plate; 6. keyboard tray raises and lowers independently from arm rest; and 7. keyboard tray distance from arm rest is longitudinally and laterally adjustable. The present device accomplishes the above with a minimum of component parts to reduce manufacturing costs and increase ease-of-use. Allowing the user to sit in a neutral, rested position while using a split computer keyboard reduces the fatigue, strain and potential nerve damage and other injuries associated with long-term computer keyboard use. Many of the above adjustments are controllable by pneumatic or hydraulic cylinders, linear motors, motors with gearing arrangements, or other automatic or manual adjustment mechanism. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
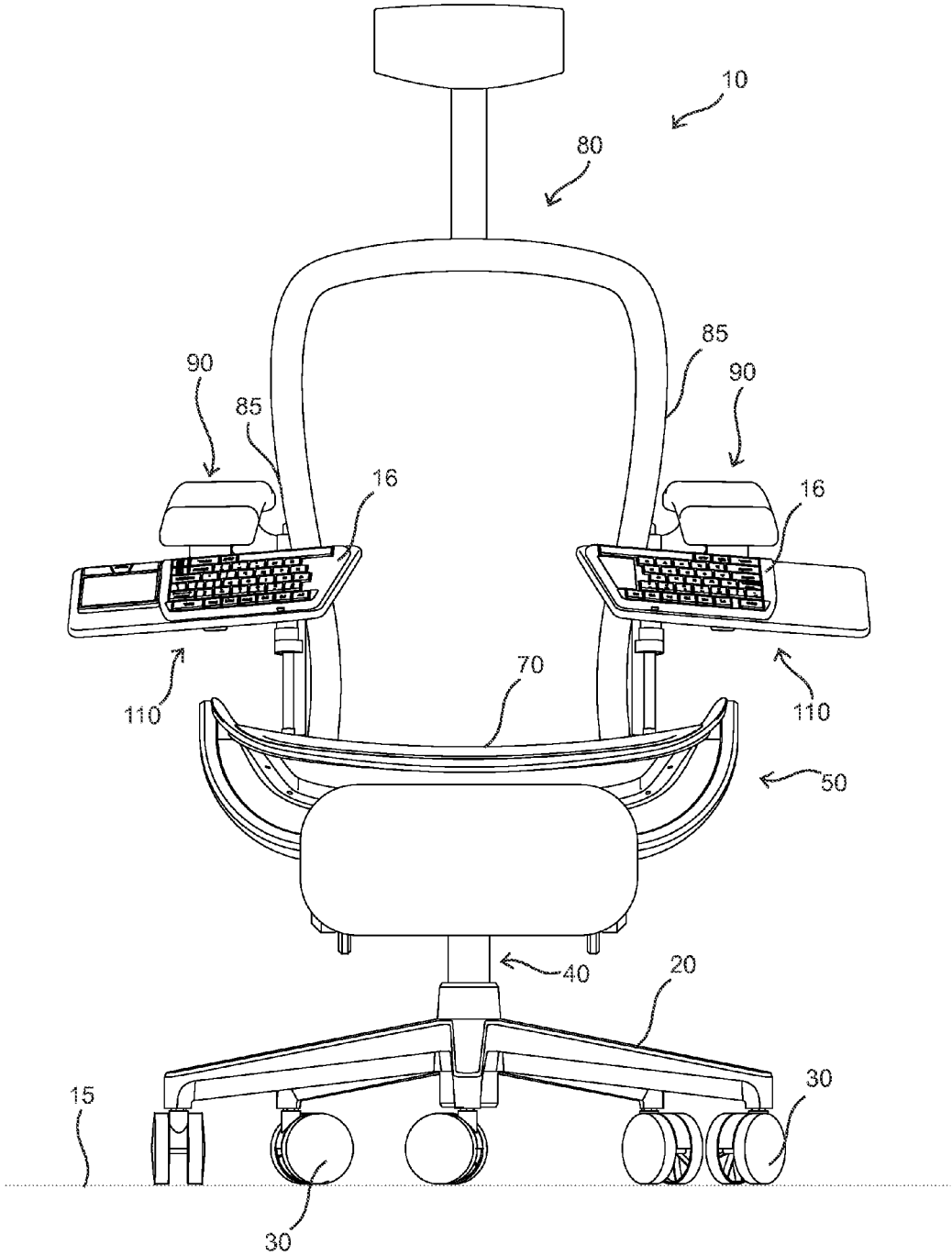
FIG. 1 is a front elevational view of the invention.
Figure 2:
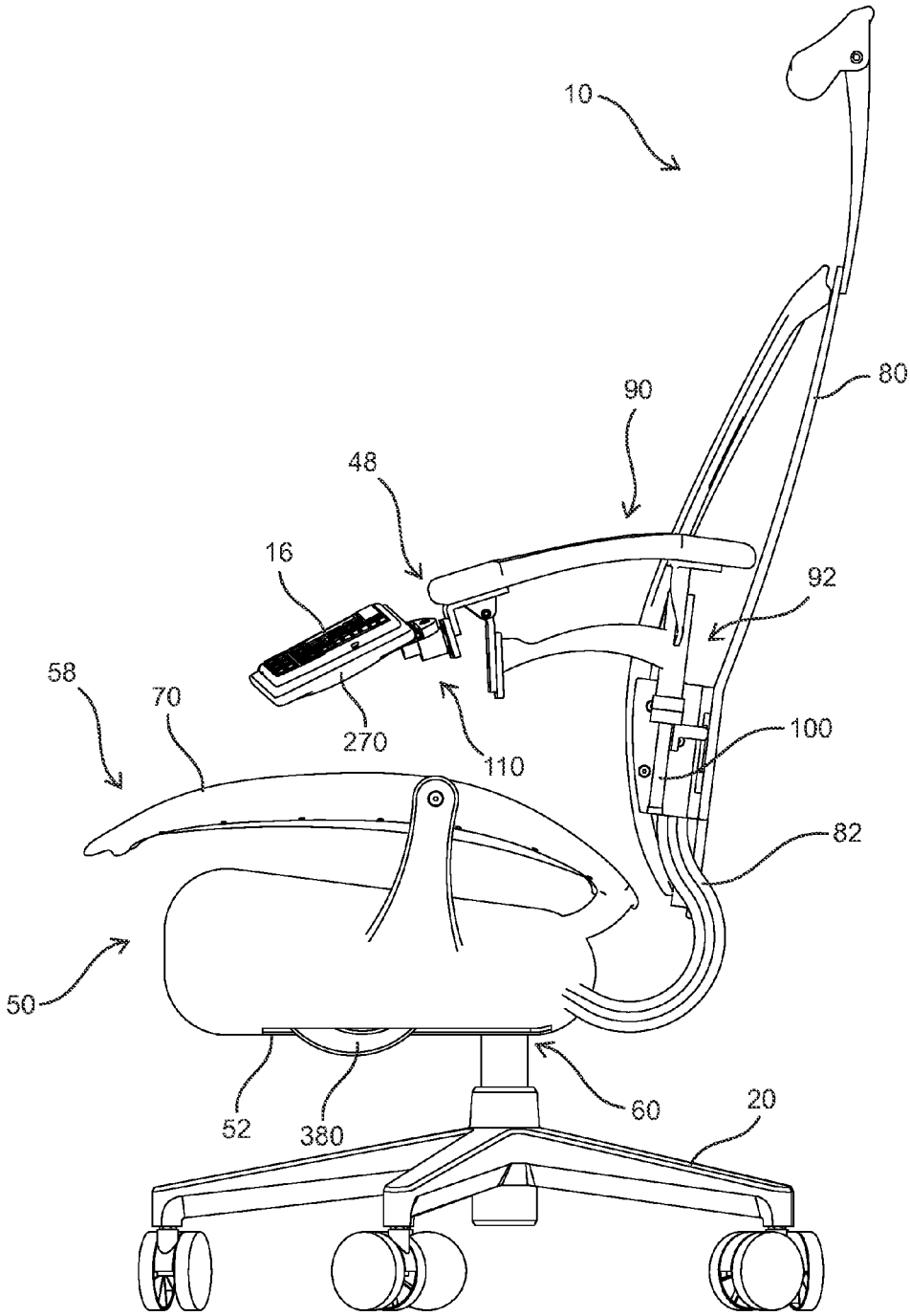
FIG. 2 is a left-side elevational view thereof.
Figure 3:
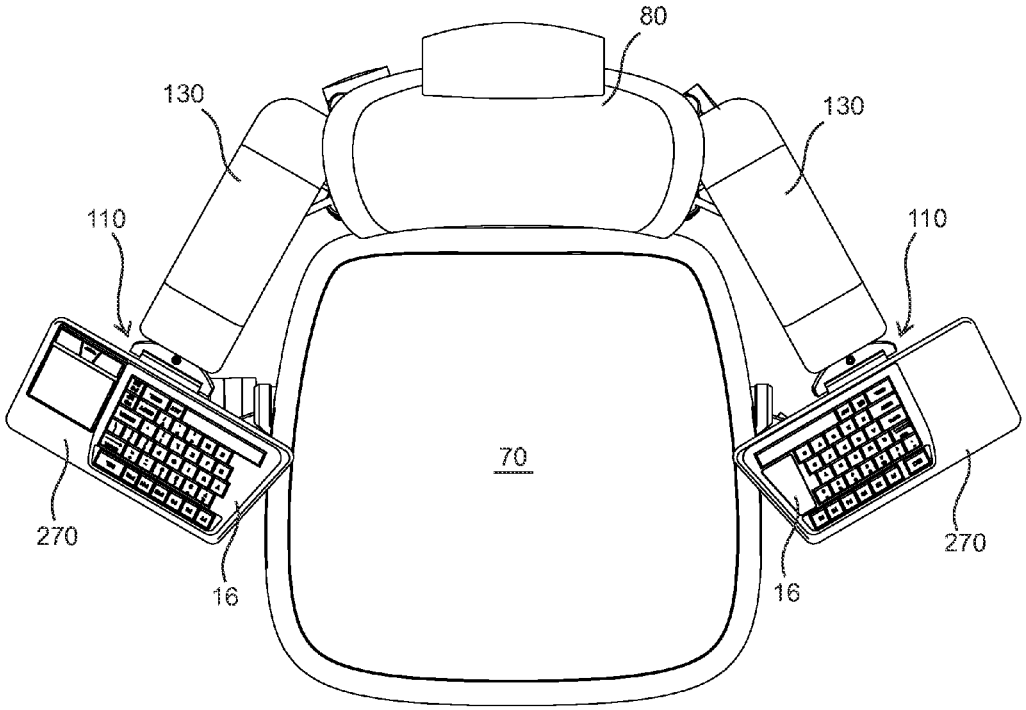
FIG. 3 is a top plan view thereof.
Figure 4:
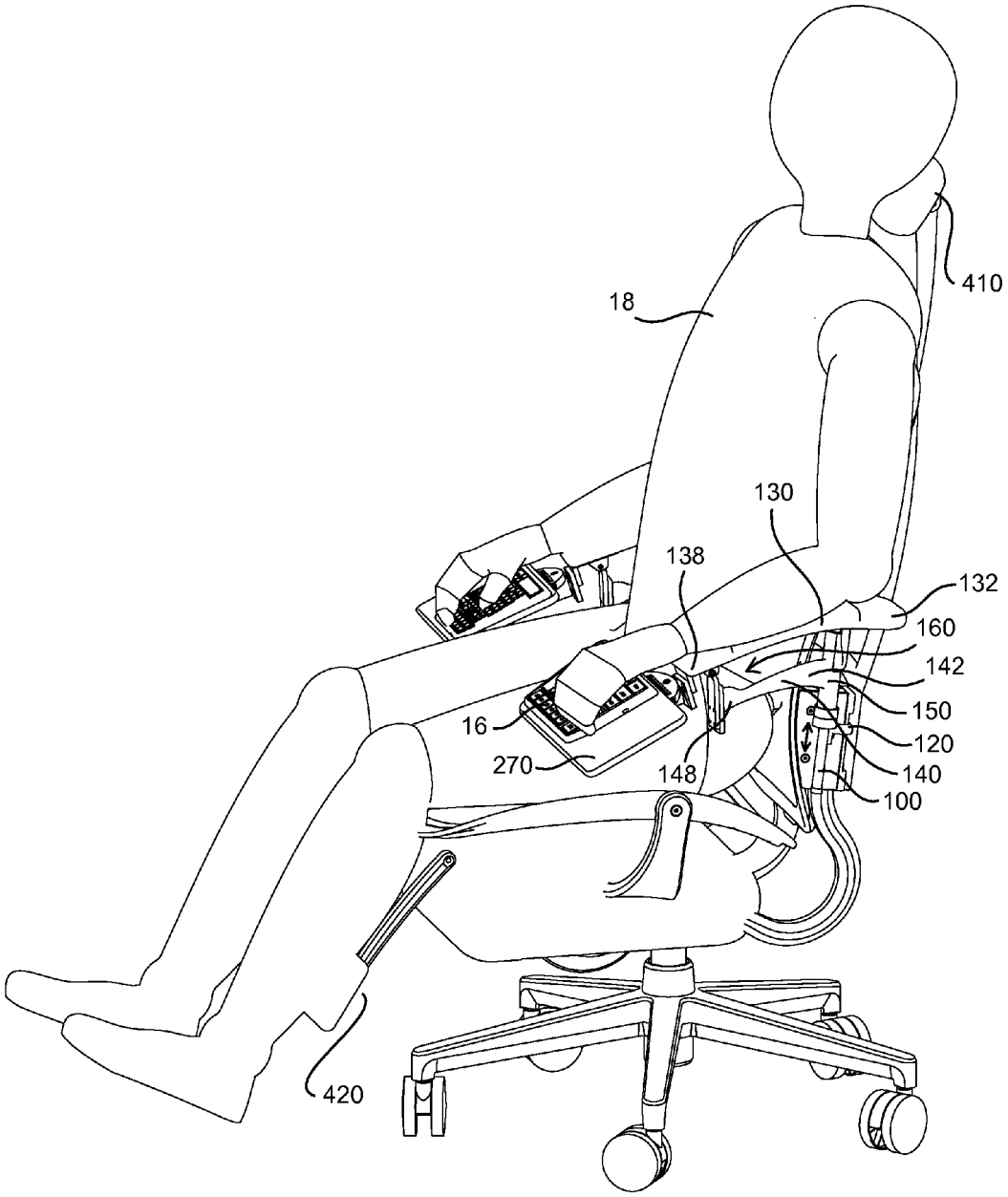
FIG. 4 is a perspective view thereof.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

FIGS. 1-4 illustrate a chair 10 for supporting a person 18 above a horizontal surface 15, such as a floor surface. The chair 10 is preferably used with a split computer keyboard 16 of the type having a left portion and a right portion, and allows the person 18 to sit in a neutral, rested position (FIG. 4) while using the keyboard 16, thereby reducing strain, pain and potential nerve damage associated by long term computer use.

A rigid base 20 has a plurality of wheels 30 each adapted for rolling along the horizontal surface 15. The base 20 further includes a rigid, central vertical shaft 40 projecting upward from the base 20. In one embodiment, the central vertical shaft 40 of the base 20 includes a shaft height adjustment mechanism and a seat actuator (not shown) therefore, such that the height of a seat mechanism 50 with respect to the horizontal surface 15 may be manually selectively adjusted by actuating the seat actuator, as is known in the art. Such a shaft height adjustment mechanism may include a gas cylinder (not shown) that is normally extended, such that actuation of the seat actuator and weight of the person 18 applied to the seat mechanism 50 forces the gas cylinder to retract to lower the height of the seat mechanism 50 with respect to the horizontal surface 15.

The seat mechanism 50 has at a lower side 52 thereof a shaft receiver 60 that is adapted for receiving the central vertical shaft 40. An upper side 58 of the seat mechanism 50 includes a support surface 70 for the person's posterior while seated. In one embodiment, the support surface 70 of the seat mechanism 50 is pivotally attached with the lower side 52 of the seat mechanism 50 and includes a seat tilt adjustment mechanism 390 with a normally locked seat tilt actuator 400. As such, tilting of the support surface 70 with respect to the lower side 52 of the seat mechanism 50 is prevented unless the seat tilt actuator 400 is actuated, whereby the tilt of the support surface 70 with respect to the lower side 52 of the seat mechanism 50 may be manually and selectively adjusted.

Figure 10:
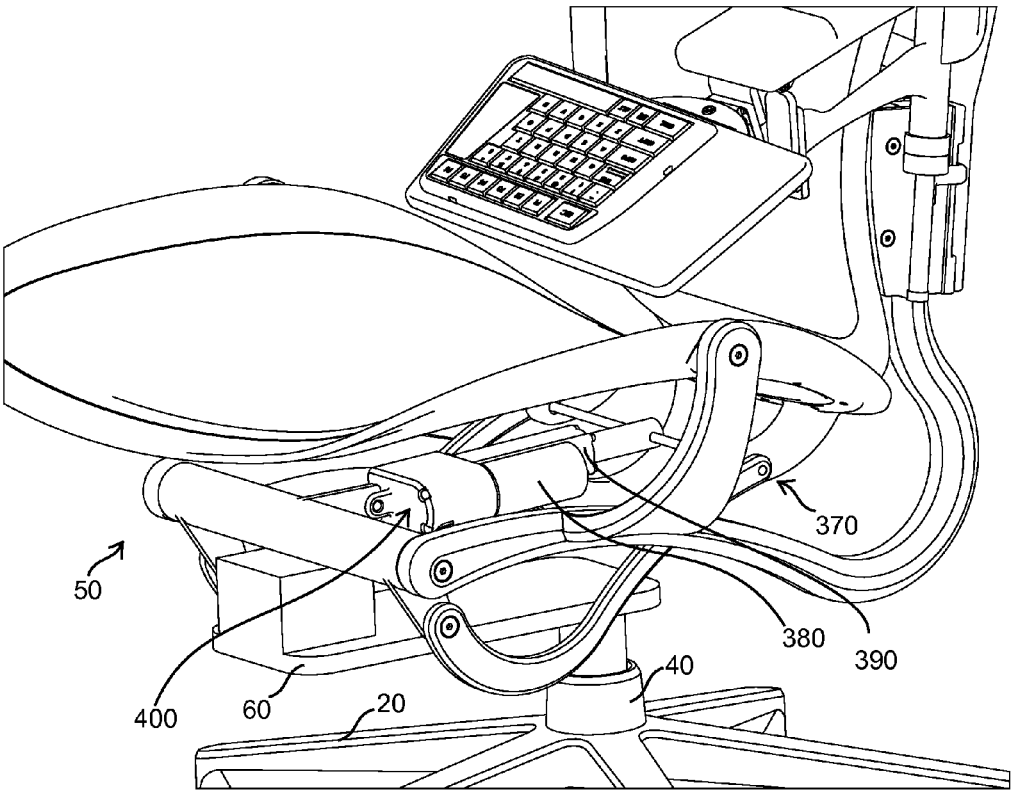
FIG. 10 is a partial perspective view of the seat mechanism thereof.

A backrest mechanism 80 is attached at a bottom side 82 thereof with the seat mechanism 50. The backrest mechanism 80 may be rotatably attached at the bottom side 82 thereof with the seat mechanism 50. In such an embodiment, a normally locked backrest tilt actuator 380 (FIG. 10) prevents rotation of the backrest mechanism 80 with respect to the seat mechanism 50 unless actuated, whereby the tilt of the backrest mechanism 80 with respect to the seat mechanism 50 may be manually and selectively adjusted. Such a backrest tilt actuator 380 may include an actuator motor (not shown) or cylinder to automatically adjust the tilt of the backrest mechanism 80 with respect to the seat mechanism 50. Such an actuator motor includes a power source and an actuator switch (not shown), as is known in the art.

A pair of opposed armrest mechanisms 90 is included, each armrest mechanism 90 projecting forward and away from opposing sides 85 of the backrest mechanism 80. Each armrest mechanism 90 further includes a proximal end 92 pivotally fixed with the backrest mechanism 80 about a substantially vertical armrest post 100. As such, the armrest mechanisms 90 may be temporarily opened or pushed away from each other to allow easier ingress or egress from the chair 10. A distal end 98 of each armrest mechanism 90 terminates in a keyboard rest mechanism 110.

Figure 9:
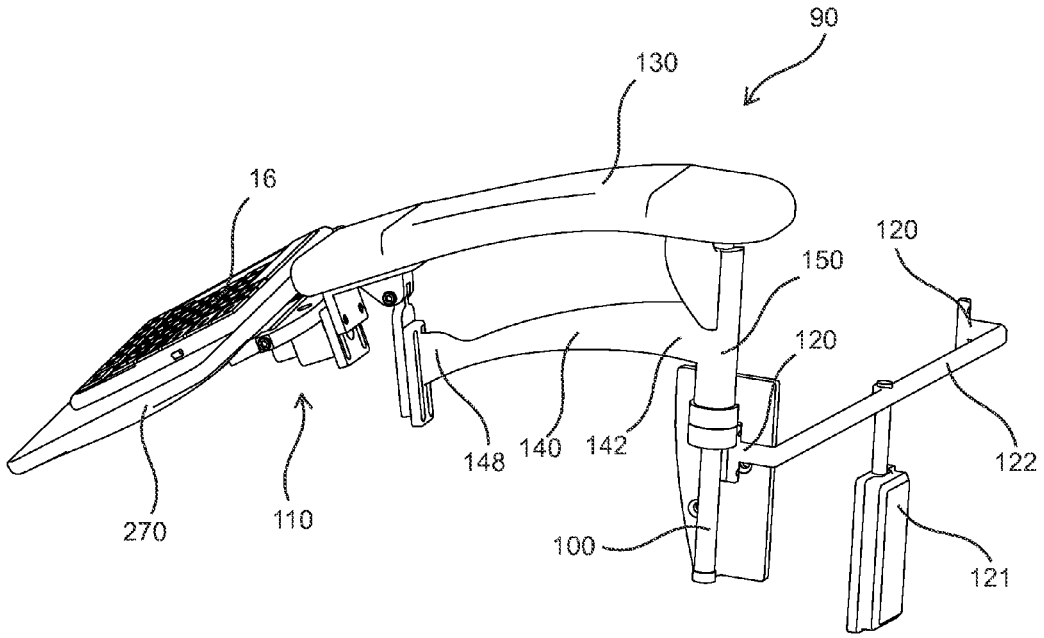
FIG. 9 is a partial rear perspective view of the armrest mechanism thereof.

Each armrest mechanism 90 may be slidably engaged with the armrest post 100 and include an armrest vertical locking mechanism 120 adapted for selective manual locking of the vertical position of the armrest mechanism 90 with respect to the armrest post 100. In one embodiment, the armrest vertical locking mechanism 120 includes an actuator motor 121 (FIG. 9) fixed with the backrest mechanism 80 and a movable horizontal armrest crossbar 122 that engages each armrest mechanism 90 to lift the armrest mechanism 90 in one direction, and to allow the armrest mechanism 90 to fall by gravity in an opposing direction. Such an actuator motor 121 is fixed with the power source and includes an electric actuator switch (not shown).

Figure 5:
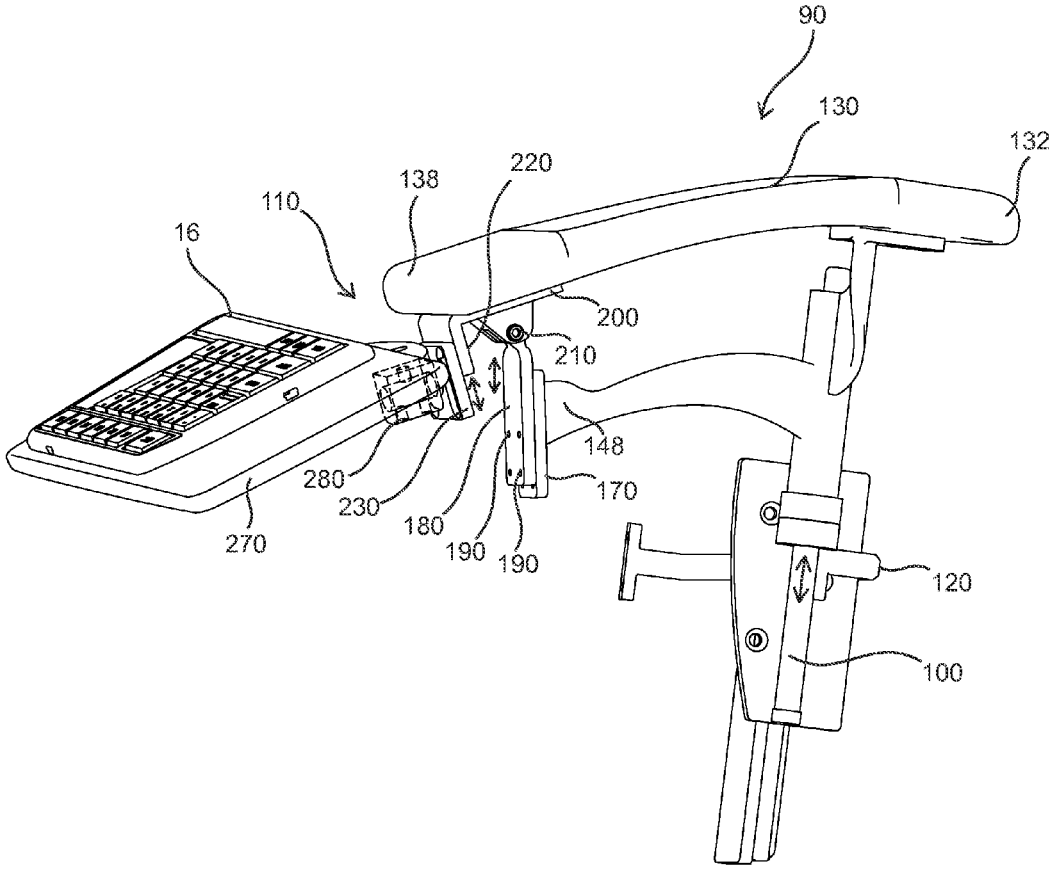
FIG. 5 is a partial left-side elevational view of the armrest mechanism thereof.

In one embodiment, each armrest mechanism 90 includes a malleable upper arm support cushion 130 and a rigid support beam 140. A proximal end 132 of the arm support cushion 130 and a proximal end 142 of the rigid support beam 140 each terminate at the proximal end 92 of the armrest mechanism 90 at a vertical armrest post receiver 150. A distal end 138 of the arm support cushion 130 terminates at a wrist support mechanism 160 and a distal end 148 of the support beam 140 terminates at a first wrist height adjustment plate 170 (FIG. 5). The armrest mechanism 90 includes a second wrist height adjustment plate 180 adapted to be slidably captured and selectively fixed with the first wrist height adjustment plate 170 with at least one wrist height adjustment screw 190. As such, the distal end 138 of the arm support cushion 130 may be selectively raised or lowered with respect to the rigid support beam 140, such that the person's wrist height relative to their elbow height when seated may be adjusted thereby.

Each wrist support mechanism 160 may include a wrist support plate 200 (FIGS. 5 and 6) pivotally fixed with the second wrist height adjustment plate 180 at a wrist pivot adjustment screw 210. As such, upon loosening of the wrist pivot adjustment screw 210 the wrist support mechanism 160 may be tilted forward or backward with respect to the second wrist height adjustment plate 180 and the rest of the chair 10 so that the angle of the person's wrist when resting on the arm support cushion 130 may be adjusted. Further, when adjusted in conjunction with the first wrist height adjustment plate 170 the curvature of the arm support cushion 130 may be adjusted.

In one embodiment, each keyboard rest mechanism 110 includes a first keyboard vertical adjustment plate 220 and a second keyboard vertical adjustment plate 230. The first keyboard vertical adjustment plate 220 is selectively, slidably, and adjustably fixed with the second keyboard vertical adjustment plate 230 with at least one keyboard vertical adjustment screw 240. As such, the height of the keyboard rest mechanism 110 with respect to the distal end 98 of the armrest mechanism 90 is selectively adjustable.

Figure 7:
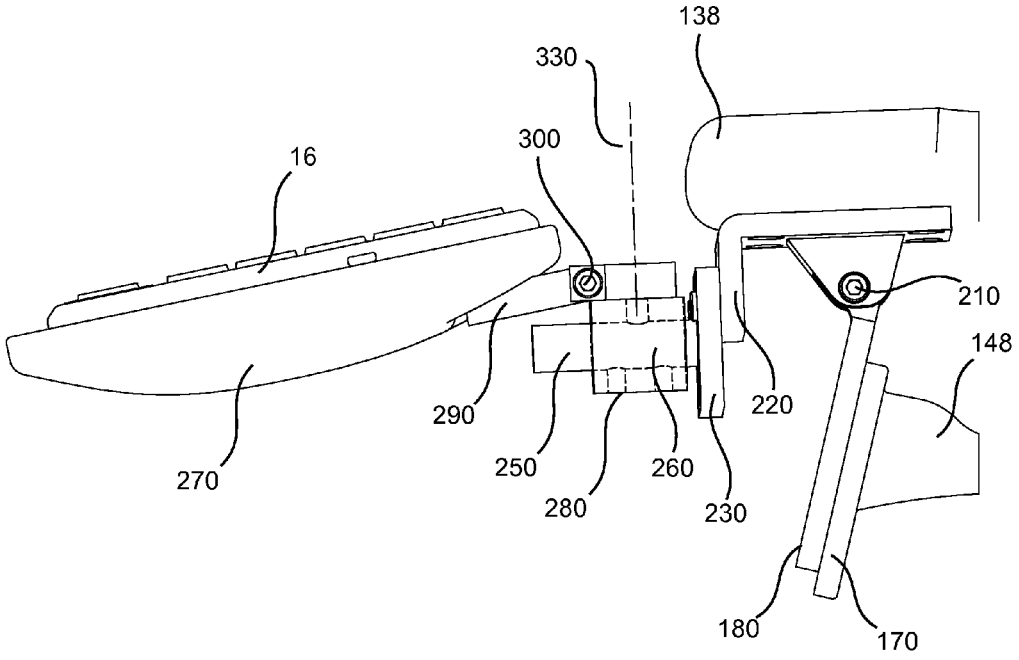
FIG. 7 is a partial left-side elevational view of the keyboard rest mechanism thereof.

In one embodiment, each keyboard rest mechanism 110 further includes a keyboard rest shaft 250 (FIG. 7) fixed with the distal end 98 of the armrest mechanism 90 that is adapted to be selectively, slidably and adjustably received by a keyboard rest shaft receiver 260 fixed with a keyboard support tray 270. A keyboard shaft locking mechanism 280 is fixed with the keyboard rest shaft receiver 260 and adapted to lock the keyboard rest shaft receiver 260 with respect to the keyboard rest shaft 250. As such, the distance between the distal end 98 of the armrest mechanism 90 and the keyboard support tray 270 is selectively adjustable.

In one embodiment, each keyboard rest shaft receiver 260 is rotatably and slidably captured on the keyboard rest shaft 250 so that the keyboard support tray 270 is further rotatably adjustable about the keyboard rest shaft 250. In one embodiment, each keyboard support tray 270 is fixed with a keyboard support bracket 290 (FIGS. 6 and 7) that is pivotally fixed through a keyboard support tray pivot screw 300 with the keyboard rest shaft receiver 260. As such, the keyboard support tray 270 may be tilted up or down with respect to the keyboard rest shaft 250 and the keyboard shaft receiver 260.

Figure 8:
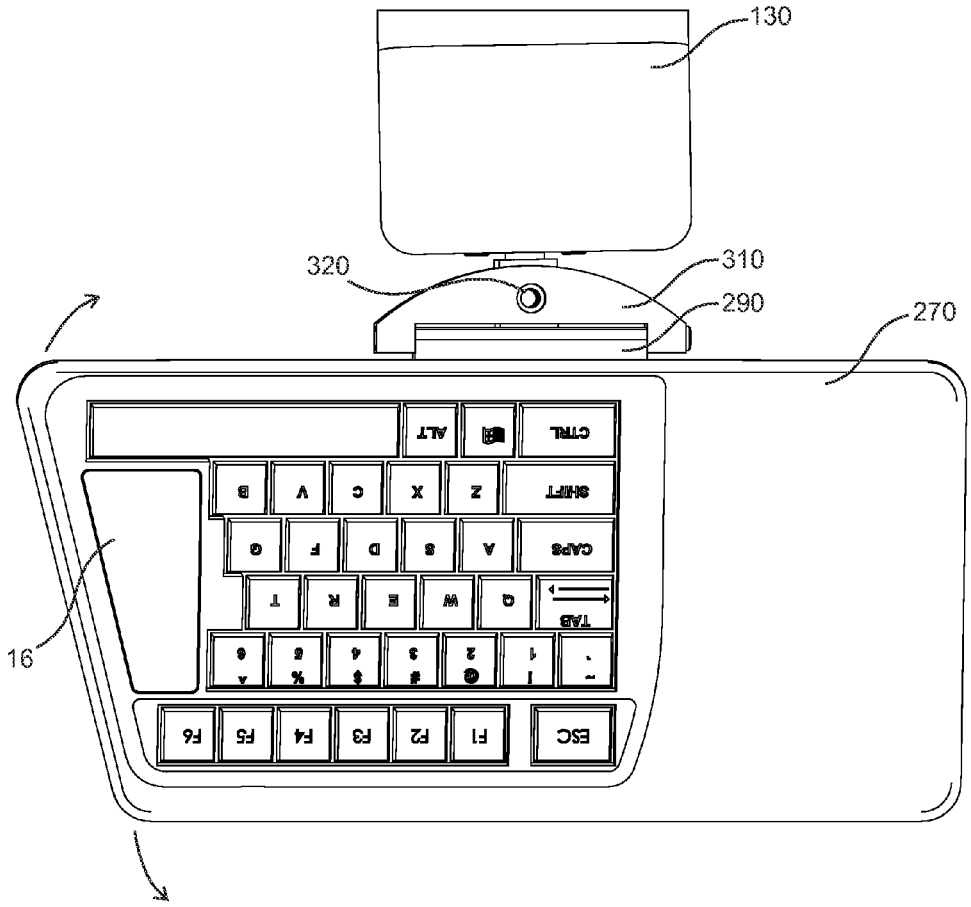
FIG. 8 is a partial top plan view of the keyboard rest mechanism thereof.

In another embodiment, the keyboard rest mechanism 110 further includes a keyboard yaw bracket 310 (FIG. 8) fixed with the keyboard support bracket 290 at a vertically oriented pivot 320. In such an embodiment the keyboard support tray 270 may be rotated about a vertical axis 330 to adjust the yaw angle with respect to the longitudinal axis of the armrest mechanism 90.

Figure 6:
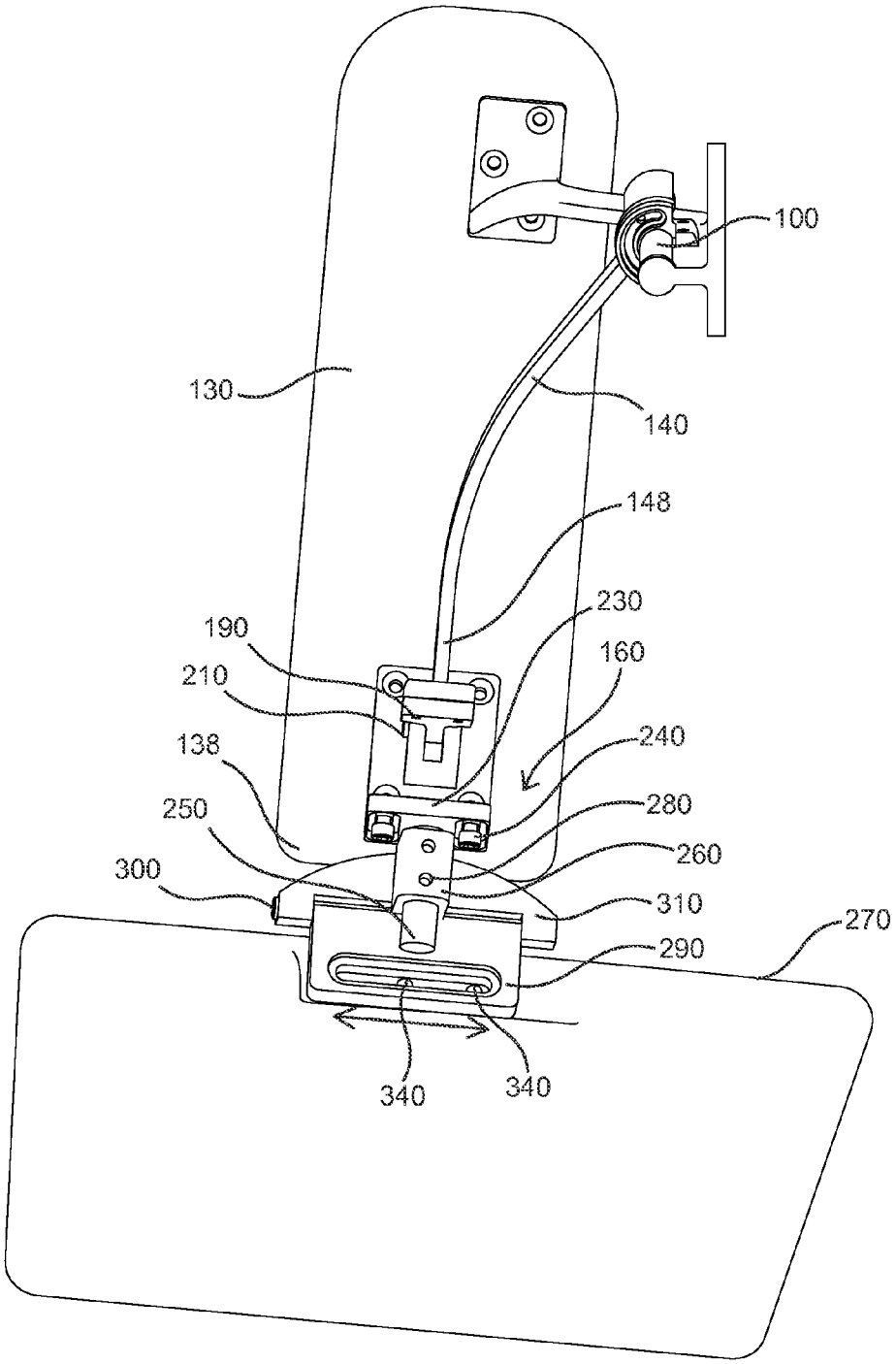
FIG. 6 is a partial bottom perspective view of a keyboard rest mechanism thereof.

In a preferred mode of the invention, each keyboard support tray 270 and keyboard support bracket 290 are mutually, slidably, selectively, and adjustably fixed with at least one keyboard lateral adjustment screw 340 (FIG. 6). As such, the keyboard support tray 270 may be laterally adjusted from left to right with respect to the distal end 98 of the armrest mechanism 90.

In one embodiment, a headrest 410 and a footrest 420 may be included. Further, cable management means (not shown) for routing electrical cables from the keyboards 16 to the base 20 of the chair 10 may be further included, such as conduits (not shown) through the rigid frame members of the chair, for example, or tie points (not shown) for elastic bands or hook-and-loop type straps or so-called Zip-Ties around elements of the chair.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A chair for supporting a person above a horizontal surface in a neutral position while utilizing a split computer keyboard, comprising:

a base adapted for resting upon the horizontal surface and a central vertical shaft projecting upward from the base;

a seat mechanism having at a lower side thereof a shaft receiver adapted for receiving the central vertical shaft and at an upper side a support surface for the person's posterior while seated;

a backrest mechanism attached at a bottom side thereof with the seat mechanism; and a pair of opposed armrest mechanisms projected away from opposing sides of the backrest mechanism, each armrest mechanism having a proximal end pivotally fixed with the backrest mechanism about a substantially vertical armrest post, and a distal end terminating in a keyboard rest mechanism, each keyboard rest mechanism for supporting one portion of the split computer keyboard;

wherein each keyboard rest mechanism includes a first keyboard vertical adjustment plate and a second keyboard vertical adjustment plate, the first keyboard vertical adjustment plate selectively, slidably, and adjustably fixed with the second keyboard vertical adjustment plate with at least one keyboard vertical adjustment screw;

whereby the person may pivot each armrest mechanism away from the chair in opposing directions to allow room for the person between the keyboard rest mechanisms for ingress or egress from the chair, and whereby the height of the keyboard rest mechanism with respect to the distal end of the armrest mechanism is selectively adjustable.

2. A chair for supporting a person above a horizontal surface in a neutral position while utilizing a split computer keyboard, comprising:

a base adapted for resting upon the horizontal surface and a central vertical shaft projecting upward from the base;

a seat mechanism having at a lower side thereof a shaft receiver adapted for receiving the central vertical shaft and at an upper side a support surface for the person's posterior while seated;

a backrest mechanism attached at a bottom side thereof with the seat mechanism; and a pair of opposed armrest mechanisms projected away from opposing sides of the backrest mechanism, each armrest mechanism having a proximal end pivotally fixed with the backrest mechanism about a substantially vertical armrest post, and a distal end terminating in a keyboard rest mechanism, each keyboard rest mechanism for supporting one portion of the split computer keyboard;

wherein each armrest mechanism is slidably engaged with the armrest post and wherein an armrest vertical locking mechanism is adapted for selective manual locking of the vertical position of the armrest with respect to the armrest post;

whereby the person may pivot each armrest mechanism away from the chair in opposing directions to allow room for the person between the keyboard rest mechanisms for ingress or egress from the chair.

3. The chair of claim 2 wherein the armrest vertical locking mechanism includes an actuator motor fixed with the backrest mechanism and a movable horizontal armrest crossbar that engages each armrest mechanism to lift the armrest mechanism in one direction, and to allow the armrest mechanism to fall by gravity in an opposing direction.

4. A chair for supporting a person above a horizontal surface in a neutral position while utilizing a split computer keyboard, comprising:

a base adapted for resting upon the horizontal surface and a central vertical shaft projecting upward from the base;

a seat mechanism having at a lower side thereof a shaft receiver adapted for receiving the central vertical shaft and at an upper side a support surface for the person's posterior while seated;

a backrest mechanism attached at a bottom side thereof with the seat mechanism; and a pair of opposed armrest mechanisms projected away from opposing sides of the backrest mechanism, each armrest mechanism having a proximal end pivotally fixed with the backrest mechanism about a substantially vertical armrest post, and a distal end terminating in a keyboard rest mechanism, each keyboard rest mechanism for supporting one portion of the split computer keyboard;

wherein the each armrest mechanism includes a malleable upper arm support cushion and a rigid support beam, a proximal end of the arm support cushion and a proximal end of the rigid support beam terminating at the proximal end of the armrest mechanism at a vertical armrest post receiver, a distal end of the arm support cushion terminating at a wrist support mechanism and the distal end of the support beam terminating at a first wrist height adjustment plate, the wrist support mechanism including a second wrist height adjustment plate adapted to be slidably captured and selectively fixed with the first wrist height adjustment plate with at least one wrist height adjustment screw;

whereby the person may pivot each armrest mechanism away from the chair in opposing directions to allow room for the person between the keyboard rest mechanisms for ingress or egress from the chair, and whereby the distal end of the arm support cushion may be selectively raised or lowered with respect to the rigid support beam, such that the person's wrist height relatively to their elbow height when seated may be adjusted thereby.

5. The chair of claim 4 wherein each wrist support mechanism includes a wrist support plate pivotally fixed with the second wrist height adjustment plate at a wrist pivot adjustment screw, whereby upon loosening of the wrist pivot adjustment screw the wrist support mechanism may be tilted forward or backward with respect to the second wrist height adjustment plate and the rest of the chair, such that the angle of the person's wrist when resting on the arm support cushion may be adjusted, and when adjusted in conjunction with the wrist height adjustment plate the curvature of the arm support cushion may be adjusted.

6. A chair for supporting a person above a horizontal surface in a neutral position while utilizing a split computer keyboard, comprising:

a base adapted for resting upon the horizontal surface and a central vertical shaft projecting upward from the base;

a seat mechanism having at a lower side thereof a shaft receiver adapted for receiving the central vertical shaft and at an upper side a support surface for the person's posterior while seated;

a backrest mechanism attached at a bottom side thereof with the seat mechanism; and a pair of opposed armrest mechanisms projected away from opposing sides of the backrest mechanism, each armrest mechanism having a proximal end pivotally fixed with the backrest mechanism about a substantially vertical armrest post, and a distal end terminating in a keyboard rest mechanism, each keyboard rest mechanism for supporting one portion of the split computer keyboard;

wherein each keyboard rest mechanism includes a keyboard rest shaft fixed with the distal end of the armrest mechanism and adapted to be selectively, slidably and adjustably received by a keyboard rest shaft receiver fixed with a keyboard support tray, a keyboard shaft locking mechanism fixed with the keyboard rest shaft receiver adapted to lock the keyboard rest shaft receiver with respect to the keyboard rest shaft;

whereby the person may pivot each armrest mechanism away from the chair in opposing directions to allow room for the person between the keyboard rest mechanisms for ingress or egress from the chair, and whereby the distance between the distal end of the armrest mechanism and the keyboard support tray is selectively adjustable.

7. The chair of claim 6 wherein each keyboard support tray is fixed with a keyboard support bracket, the keyboard support bracket being pivotally fixed through a keyboard support tray pivot screw with the keyboard rest shaft receiver, whereby the keyboard support tray may be tilted up or down with respect to the keyboard rest shaft and shaft receiver.

8. The chair of claim 6 wherein each keyboard rest shaft receiver is rotatably and slidably captured on the keyboard rest shaft, whereby the keyboard support tray is further rotatably adjustable about the keyboard rest shaft.

9. The chair of claim 7 wherein each keyboard rest mechanism further includes a keyboard yaw bracket fixed with the keyboard support bracket at a vertically oriented pivot, whereby the keyboard support tray may be rotated about a vertical axis to adjust the yaw angle with respect to the longitudinal axis of the armrest mechanism.

10. A chair for supporting a person above a horizontal surface in a neutral position while utilizing a split computer keyboard, comprising:

a base adapted for resting upon the horizontal surface and a central vertical shaft projecting upward from the base;

a seat mechanism having at a lower side thereof a shaft receiver adapted for receiving the central vertical shaft and at an upper side a support surface for the person's posterior while seated;

a backrest mechanism attached at a bottom side thereof with the seat mechanism; and a pair of opposed armrest mechanisms projected away from opposing sides of the backrest mechanism, each armrest mechanism having a proximal end pivotally fixed with the backrest mechanism about a substantially vertical armrest post, and a distal end terminating in a keyboard rest mechanism, each keyboard rest mechanism for supporting one portion of the split computer keyboard;

wherein each keyboard rest mechanism further includes a keyboard support tray and a keyboard support bracket, each mutually, slidably, selectively, and adjustably fixed with at least one keyboard lateral adjustment screw;

whereby the person may pivot each armrest mechanism away from the chair in opposing directions to allow room for the person between the keyboard rest mechanisms for ingress or egress from the chair, and whereby the keyboard support tray may be laterally adjusted from left to right with respect to the distal end of the armrest mechanism.

11. The chair of claim 7 wherein the keyboard support tray and a keyboard support bracket are each mutually, slidably, selectively, and adjustably fixed with at least one keyboard lateral adjustment screw, whereby the keyboard support tray may be laterally adjusted from left to right with respect to the distal end of the armrest mechanism.

* * * * *